US011591978B1

(12) United States Patent
Fulcher et al.

(10) Patent No.: US 11,591,978 B1
(45) Date of Patent: Feb. 28, 2023

(54) SPEED CONTROL FOR A MOBILE MACHINE

(71) Applicant: Caterpillar Inc., Peoria, IL (US)

(72) Inventors: Richard L. Fulcher, Peoria, IL (US); Ethan M. Tevis, Bloomington, IL (US); Matthew D. Dobsch, Champaign, IL (US)

(73) Assignee: Caterpillar Inc., Peoria, IL (US)

( * ) Notice: Subject to any disclaimer, the term of this patent is extended or adjusted under 35 U.S.C. 154(b) by 0 days.

(21) Appl. No.: 17/744,132

(22) Filed: May 13, 2022

(51) Int. Cl.
*F02D 31/00* (2006.01)
*E02F 9/20* (2006.01)

(52) U.S. Cl.
CPC ..... *F02D 31/009* (2013.01); *E02F 9/2066* (2013.01); *F02D 2200/50* (2013.01); *F02D 2200/602* (2013.01)

(58) Field of Classification Search
CPC ..... F02D 31/009; F02D 2200/50; F02D 2200/602; E02F 9/2066
USPC ..... 123/350, 363, 399, 436; 701/103, 110
See application file for complete search history.

(56) References Cited

U.S. PATENT DOCUMENTS 5,417,193 A 5/1995 Fillman et al.
5,553,453 A 9/1996 Coutant et al.
6,581,710 B2 6/2003 Sprinkle et al.
6,655,233 B2 * 12/2003 Evans ..... F16H 61/47 74/731.1
6,655,351 B2 12/2003 Sheidler et al.
7,287,620 B2 10/2007 Thomas et al.
7,472,684 B1 * 1/2009 McKee ..... F02D 29/02 123/352
7,637,845 B2 * 12/2009 Strashny ..... B60K 31/04 477/110
7,641,588 B2 1/2010 Thomson et al.
7,735,592 B2 * 6/2010 Bellot ..... A01D 69/025 180/165
8,131,434 B2 * 3/2012 Nishi ..... F02D 31/009 701/50
8,676,474 B2 * 3/2014 Peterson ..... F02D 41/0215 701/1

* cited by examiner

*Primary Examiner* — Hai H Huynh

(74) *Attorney, Agent, or Firm* — Leydig, Voit & Mayer, Ltd

(57) ABSTRACT

A mobile machine includes an internal combustion engine operatively connected to a plurality of propulsion devices for travel over a work surface. The mobile machine can include an electronic controller that receives condition data signals indicative of the operating state or condition of the mobile machine from a plurality of condition input sensors. The electronic controller compares the condition data signals with condition threshold to determine whether to operate the internal combustion engine in accordance with rated engine speed range or an adjusted engine speed range.

20 Claims, 5 Drawing Sheets

SPEED CONTROL FOR A MOBILE MACHINE

TECHNICAL FIELD

The present disclosure relates generally a mobile machine for conducting an earth working operation and more particularly to a system and method for regulating the ground speed capability of the mobile machine.

BACKGROUND

Various types of mobile machines are used to conduct different types of earth working operations to alter the topology at a worksite in industries such as construction, mining and agriculture. Typically, such machines will include a ground-engaging implement for altering the work surface such as a blade or a bucket that can physically displace the earthen material at the work site. Examples of such mobile machines can include motor graders, dozers, wheel loaders, excavators and the like.

To propel the mobile machine about the worksite, including during use of the ground-engaging implement, the mobile machine can include a prime mover such as an internal combustion engine that can generate and transmit torque or rotational power through a drivetrain to a plurality of propulsion devices like wheels. To adjust the rotational speed associated with the output of the internal combustion engine, the drivetrain can include a transmission having a plurality of gears that can be selectively engaged to change the gear ratio of the transmission, and thus the rotational speed and torque transmitted to the propulsion devices.

In some circumstances, it may be desirable to enable a relatively finer degree of control over the rotational speed of the drivetrain even when operating within a particular gear ratio. For example, at the end of an earth-working operation, the ground-engaging implement of the mobile machine may be used to perform highly precise alterations to the worksite, a process that may be referred to as finishing. The present disclosure is directed to systems and methods for regulating the operation of an internal combustion engine and drivetrain to enable a greater degree of control over the speed of the mobile machine for such purposes.

SUMMARY

The disclosure describes, in one aspect, a mobile machine for an earth working operation that includes a machine frame supported on a plurality of propulsion devices for travel over a work surface and an internal combustion engine operatively connected to the plurality of propulsion devices by a drivetrain to provide rotational speed and power for propulsion. The drivetrain can include a transmission having a plurality of fixed gear ratios. The mobile machine can also include a plurality of condition input sensors configured to sense one or more operating conditions of the mobile machine. To assess the operating conditions of the mobile machine sensed by the condition input sensors, an electronic controller can be in data communication with condition input sensors to receive the condition data signals. The electronic controller can be programmed to regulate operation of the internal combustion engine in accordance with a rated engine speed range that constrains the rotational speed of the internal combustion engine to a rated minimum engine speed and a rated maximum engine speed. Upon receiving the condition data signals, the electronic controller can compare the condition data signals with one or more condition thresholds. Based on the comparison, the electronic controller can be programmed to regulate operation of the internal combustion engine in accordance with an adjusted engine speed range that is different from the rated engine speed range.

In another aspect, the disclosure describes a method of speed control for a mobile machine during an earth working operation. The method may regulate operation of an internal combustion engine within a rated engine speed range that constrains a rated minimum engine speed and a rated maximum engine speed. The internal combustion engine is configured to transmit rotational speed through a drivetrain to a plurality of propulsion devices for travel over a work surface. A plurality of condition input sensors can generate and communicate condition data signals that are indicative of a change in an operating condition of the mobile machine to a computational device or program. The condition data signals may be compared with a condition threshold and, based on the comparison, the method may then regulate operation of the internal combustion engine within an adjusted engine speed range that is different from the rated engine speed range.

In yet another aspect of the disclosure, there is described a speed control system for a mobile machine that includes a plurality of condition input sensors configured to sense one or more operating conditions of the mobile machine and to communicate condition data signal indicative of the one or more operating conditions to an electronic controller. The electronic controller can be programmed to regulate operation of an internal combustion engine in accordance with a rated engine speed range having a rated minimum engine speed and a rated maximum engine speed. Upon receiving the condition data signals, the electronic controller can compare the condition data signals with one or more condition thresholds. Based on the comparison, the electronic controller can be programmed to regulate operation of the internal combustion engine in accordance with an adjusted engine speed range that is different from the rated engine speed range.

DETAILED DESCRIPTION

Figure 1:
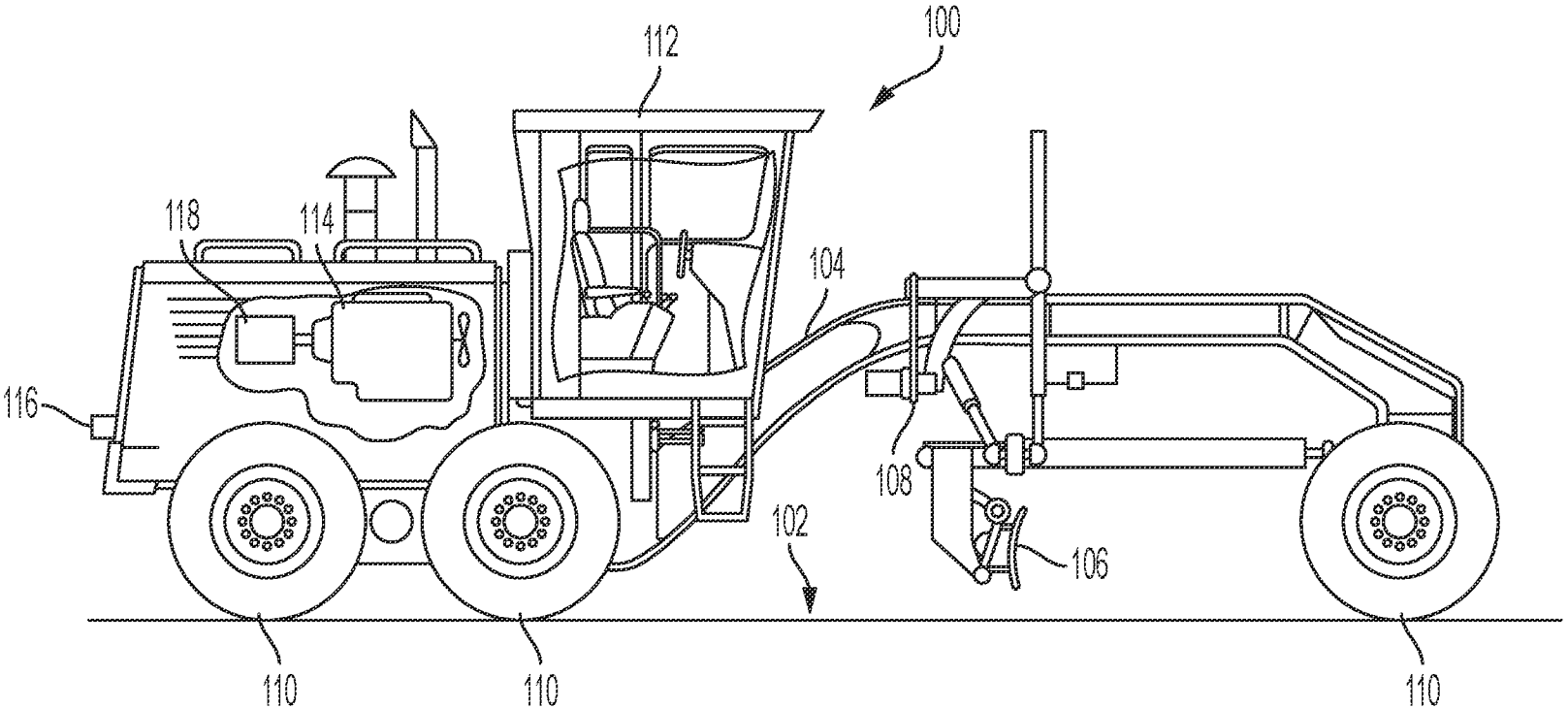
FIG. 1 is a side elevational view of a mobile milling machine in the particular embodiment of a motor grader for conducting an earth working operation that includes an internal combustion engine operatively connected to a plurality of propulsion devices by a drivetrain.

Now referring to the drawings, wherein whenever possible like reference numbers refer to like features, there is illustrated in FIG. 1 an embodiment of a mobile machine 100 for earth working operation to alter the shape of a work surface 102 in the particular embodiment of a motor grader. As is familiar to those of skill in that art, a mobile machine 100 such as a motor grader may include machine frame 104 from which is suspended a ground-engaging implement 106 like blade that can be arranged in various positions with respect to the work surface 102 by a linkage 108 that connects the blade to the machine frame 104. The ground-engaging implement 106 in the form of a blade can contact the work surface 102 to displace earthen material thereon in a shaping or contouring operation. While the disclosed embodiment of a mobile machine 100 is a motor grader with a ground-engaging implement 106 in the form of a blade, aspects of the disclosure may be applicable to other types of mobile machines 100 for earth working operations such as dozers, wheel loaders, excavators, and the like.

To enable the mobile machine 100 to travel over the work surface 102, the machine frame 104 can be supported on a plurality of propulsion devices 110 such as rotatable wheels having rubber pneumatic tires. In other embodiments, the propulsion devices 110 can be continuous tracks such as a closed belt disposed about rollers and/or sprockets where translation of the belt carries the machine frame 104 over the work surface 102. To propel and direct the machine with respect to the work surface 102, at least one set of the propulsion devices 110 may be power-driven to rotate and/or another set may be steerable by an operator onboard, remotely, or by another control scheme.

By way of example, in the embodiment where the where the mobile machine 100 is operated by an onboard operator, an operator station 112 or cab can be located on the machine frame 104 in a position to provide the operator visibility over the work surface 102 and worksite. The operator station 112 can include various controls, readouts, and other input/output interfaces for monitoring and controlling operation of the mobile machine 100. For example, the operator station 112 can include steering joysticks or steering handles for adjusting the travel direction of the mobile machine 100, speed controls for adjusting the travel speed of the mobile machine 100, and implement controls for operating the ground-engaging implement 106. In other embodiments where the mobile machine 100 is configured for remote operation, some or all of the foregoing operator controls may be located remotely from the onboard operator station 112.

To provide power to the propulsion devices 110 and to the mechanisms for actuating the ground-engaging implement 106, a power source or prime mover may be disposed on the machine frame 104. An example of a prime mover is an internal combustion engine 114, such as a compression ignition diesel engine, that burns a hydrocarbon-based fuel or another combustible fuel source to convert the potential or chemical energy therein to mechanical rotational power or torque that may be utilized for other work. Other suitable types of prime movers that can be used by the mobile machine 100 can include spark-ignition gasoline engines, hybrid engines and the like. As described below, the internal combustion engine 114 or other prime mover may be associated with an exhaust system 116 including an exhaust pipe to direct exhaust gases from the combustion process away from the engine to the environment. The exhaust system 116 can include various aftertreatment devices and systems to treat the exhaust gases before discharge to the environment.

To transmit the rotational power or torque produced by the internal combustion engine 114 to the propulsion devices 110 and other powered systems of the mobile machine 100, a drivetrain 118 can operatively connect the internal combustion engine 114 with those systems and devices. A drivetrain 118 is an assembly of components that can alter the speed, torque, and/or direction of the rotational power output by the internal combustion engine 114 so that it can be more advantageously used by the other devices and systems at the point of application. For example, the internal combustion engine 114 may operate efficiently only in a specific engine speed range of rotational speeds and torques. In the example of a diesel burning internal combusting engine 114, the output speed range may be from 200 RPM to 2000 RPM, below which the engine may stall and above which the engine will be over-worked. However, the propulsion devices 110 may need to operate the mobile machine 100 at a lesser or greater speeds or the mobile machine may need to be brought to a stop with respect to the work surface 102.

Figure 2:
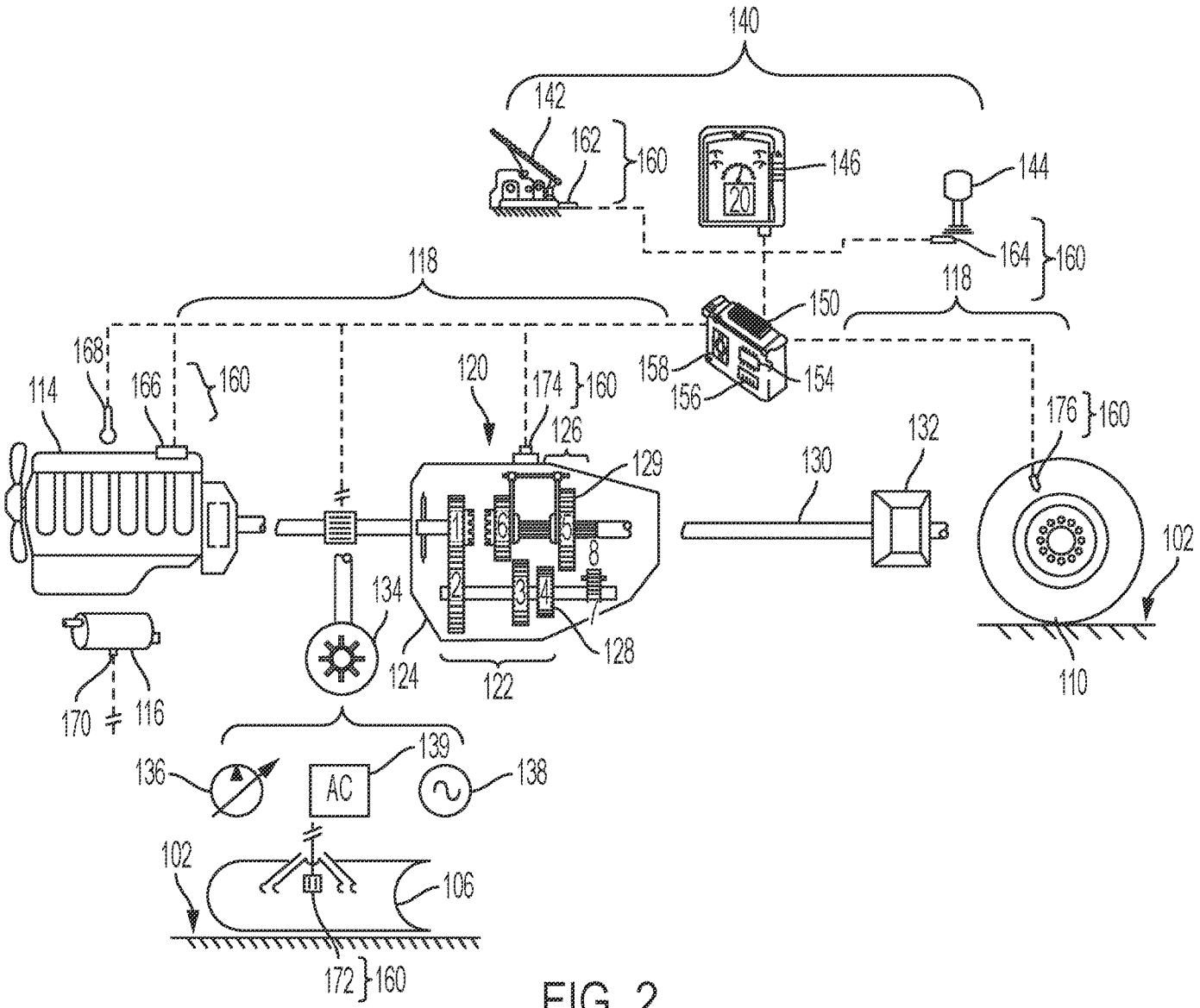
FIG. 2 is a schematic representation of the drivetrain for a mobile machine that is operatively associated with an electronic controller and a plurality of condition input sensors that are configured to regulate the engine speed ranges of the internal combustion engine.

Accordingly, referring to FIG. 2, to enable selective changing of the speed and torque output of the internal combustion engine 114, the drivetrain 118 can include or be associated with a multispeed transmission 120. The transmission 120 can include a plurality of selectively engageable gears 122 of different sizes disposed in a transmission housing 124 that can vary the rotational speed and, in a generally inverse relation, the torque produced by the internal combustion engine 114. The gears 122 can have straight cut or diagonally cut teeth that mesh together such that rotation of the first gear rotatably drives the second gear. The diameters and the number and spacing of the teeth of the gears 122 can be different so that a pair of intermeshed gears will rotate at different rotational speeds. The transmission 120 can be configured with multiple fixed gear ratios that represent different ratios between input speed and output speed of the transmission.

In an embodiment, the plurality of fixed gear ratios associated with the transmission 120 may include a low gear ratio 126 which produces the lowest rotational speed that is output from the transmission 120 compared to other fixed gear ratios. The low gear ratio 126 may have a relatively larger input gear 128 that is driven by the rotational input from the internal combustion engine 114 and a relatively larger output gear 129 that can be selectively meshed with the input gear 128. The difference in diameters between the input gear 128 and the output gear 129 thereby causes a reduction in the rotation speed transferred through the transmission 120. The transmission 120 may include any suitable number of higher fixed gear ratios that produce higher rotational speed outputs relative to the low gear ratio of the transmission.

The transmission 120 can be operatively coupled to a driveshaft 130 that transmits and distributes the rotational power as adjusted by the transmission to the other components and devices of the drivetrain 118. For example, the driveshaft 130 can be connected to one or more of the propulsion devices 110 through a differential 132 or the like to cause the propulsion devices to rotate over the work surface 102. In addition, the drive train 118 can be operatively connected with and operatively drive one or more auxiliary systems via an auxiliary power takeoff (PTO) 134. The auxiliary power takeoff 134 can be in the embodiment of a splined collar on the driveshaft 130 and associated gears that can redirect or retransmit a portion of the rotational power to power or drive the auxiliary systems. Examples of auxiliary systems can include a hydraulic pump 136 associated with a hydraulic system of the mobile machine 100, an electric generator 138 associated with an electrical system of the mobile machine 100, and an air conditioning system 139 to cool the operator station. In addition, the auxiliary power takeoff 134 may direct rotational power to the ground-engaging implement 106 such as a blade associated with the mobile machine 100. The auxiliary power takeoff 134 can be operatively connected to the powertrain 118 before or after the transmission 120.

To selectively adjust and control operation of the internal combustion engine 114 and the drivetrain 118, one or more operator input/output devices 140 may be included the that operator of the mobile machine 100 can interface with. For example, the operator input/output devices 140 can include a throttle pedal or speed pedal 142 that can be depressed or released to command a change in the rotational speed produced by the internal combustion engine 114 and thus the ground speed or velocity of the mobile machine 100. In the embodiment of a diesel burning internal combustion engine 114, the rotational speed in RPMs may be increased or decreased by changing the quantity of diesel fuel introduced to the combustion chambers per combustion cycle. Another example of an operator input/output device 140 can be a gearshift stick 144 that is movable through various positions by which the operator can select a change in the engaged fixed gear ratios of the transmission 120.

Another example of an operator input/output device 140 can be a display monitor 146 that can present a visual display to the operator representing various performance characteristics and operational aspects of the mobile machine 100. The display monitor 146 can be a liquid crystal display, a plasma display, or a handheld device and may have touchscreen capabilities to interact with and receive commands from the operator. Other possible examples of operator input/output devices can include brake pedal for retarding the speed or velocity of the mobile machine 100, clutch pedals for engaging or disengaging the transmission 120 from the internal combustion engine 114, steering wheels or joysticks to control the travel direction the mobile machine 100, and the like.

To coordinate input from the operator input/output devices 140 with the operation of the internal combustion engine 114 and the drivetrain 118, an electronic controller 150, also referred to as an electronic control module (ECM) or electronic control unit (ECU), can be included with the mobile machine 100. The electronic controller 150 can include various circuitry components for receiving and processing data and software to operate the internal combustion engine 114 and the drivetrain 118. Additionally, the electronic controller 150 can be responsible for processing functions associated with various other systems on the mobile machine 100. While the electronic controller 150 is illustrated as a standalone device, its functions may be distributed among a plurality of distinct and separate components.

For example, the electronic controller 150 can include one or more microprocessors 158 such as a central processing unit (CPU), an application specific integrated circuit (ASIC), or a field programmable gate array (FPGA) comprising a plurality of transistors and similar circuits that are capable of reading, manipulating and outputting data in electronic form. The electronic controller 150 can include non-transient programmable memory 154 or other data storage capabilities that may be random access memory or more permanent non-volatile forms of data storage media. Common examples of computer-readable memory 214 include RAM, PROM, and EPROM, a FLASH-EPROM, and any other memory chip or cartridge. The memory is capable of storing, in software form, the programming instructions and the data that can be read and processed by the microprocessor 158. The software and data may take the form of instruction sets, programs, applications, routines, libraries, databases, lookup tables, data sets, and the like.

To communicate with the operator input/output devices 140 and other instruments and actuators associated with the internal engine 114 and the drivetrain 118, the electronic controller 150 can include various input/output ports 156 and related circuitry. Communication may be established by sending and receiving digital or analog signals across electronic communication lines or communication busses using any suitable data communication protocols. The various communication and command channels are indicated in dashed lines for illustration purposes.

To obtain data and information about the operating conditions or states of the mobile machine 100, the electronic controller 150 can be communicatively associated with one or more condition input sensors 160. The condition input sensors 160 can be any suitable type of device capable of measuring or monitoring the physical condition associated with a device or system of the mobile machine 100 and can output a signal, referred to as a condition data signal, indicative of that information to the electronic controller 150. The condition data signals can be embodied as electrical communication signals represented by voltage and or current that can be transmitted by conductive wires, or may be wireless signals transferred by radio waves such a Bluetooth or Wi-Fi signals.

Among the plurality of condition input sensors 160 generating and communicating condition data signals can be a speed pedal sensor 162 operatively associated with the speed pedal 142. The speed pedal sensor 162 can measure the articulation of the speed pedal 142 with respect to a reference that represents the commanded output speed of the internal combustion engine 114 and/or the mobile machine 100. Another condition input sensor 160 can be a gear selection sensor 164 associated with the gearshift stick 144 that can sense and communicate the fixed gear ratio selected by the operator, which is also a manner of adjusting the output speed transmitted through the drivetrain 118.

In addition to the condition input sensors 160 associated with the operator input/output devices 140, condition input sensors 160 can be associated with the mechanical components of the mobile machine 100. For example, an engine speed sensor 166 can be associated with the internal combustion engine 114 and can measure the rotational output speed and/or torque from the internal combustion engine. For example, the engine speed sensor 166 can be a magnetic pickup sensor that measures the rotational speed of the crankshaft protruding from the internal combustion engine 114. Another condition input sensor 160 can be an engine temperature sensor 168 that can measure the operating temperature of the internal combustion engine 114, either directly or indirectly through measuring the temperature of the coolant or lubrication oil associated with the internal combustion engine 114.

The condition input sensors 160 may also measure certain conditions associated with the exhaust system 116 coupled to the internal combustion engine 114. For example, an exhaust sensor 170 can be disposed in the exhaust system 116 and can measure the temperature of the exhaust gases, the flow rate of the exhaust gases, or the chemical constituents of the exhaust gases. The electronic controller 150 can analyze that information to discern the operating conditions of the internal combustion engine 114. For example, the presence of certain chemical constituents in the exhaust gases can be indicative of the combustion process and more generally of the performance of the internal combustion engine 114.

The condition input sensors 160 can also measure or sense the operational states of the one or more auxiliary systems associated with the auxiliary power takeoff 134 operatively coupled to the driveshaft 130, including any of the hydraulic pump 136, the electrical generator 138, and/or the air conditioning system 139. Similarly, the condition input sensors 160 may include an implement sensor 172 operatively associated with the ground-engaging implement 106 of the mobile machine 100. In the embodiment of a motor grader, for example, the implement sensor 172 can sense the position of the ground-engaging implement 106 or blade with respect to the machine frame, for example, an inertia measurement unit measuring pitch, tilt, or slope, or the implement sensor 172 may sense a load force applied to the ground-engaging implement 106 or blade when it encounters and displaces the earthen material on the work surface 102. The implement sensor 172 can thus sense whether the ground-engaging implement 106 is physically engaged or disengaged with the work surface 102.

To determine the operational conditions or states associated with the drivetrain 118, the condition input sensors 160 can include a transmission sensor 174 associated with the transmission 120. The transmission sensor 174 can sense the engaged fixed gear ratio or the change of the rotational speed and/or torque directed through the transmission 120. Furthermore, the condition input sensors 160 may include a ground speed sensor 176 operatively associated with the propulsion devices 110 that measures the final output speed of the drivetrain 118 at the final point of application. The ground speed sensor 176 may output condition data signals indicative of the ground in units of distance over time, such as miles per hour.

As indicated above, the internal combustion engine 114 may be physically limited to operate within a rated engine speed range having a rate minimum engine speed and a rated maximum engine speed. Adjustments to the rotational speed output by the internal combustion engine 114 can accomplished by the components of the drivetrain 118 including the transmission 120 by, for example, selectively engaging different fixed gear ratios so that the propulsion devices 110 can propel the mobile machine 100 across a great range of speeds. The individual fixed gear ratios may also be limited to operate within a fixed speed range, and by selecting different fixed gear ratios associated with the transmission, the rotation speed transmitted through the driveshaft may be further adjusted. However, under certain operating conditions, it may be desirable to enable the mobile machine 100 to operate within a greater speed range having different minimum and maximum speeds. For example, where the mobile machine 100 is a motor grader, it may be desirable to operate at a sufficiently low operational travel speeds to facilitate precise contouring of the work surface 102 with the ground-engaging implement 106 during a finishing operation.

Figure 3:
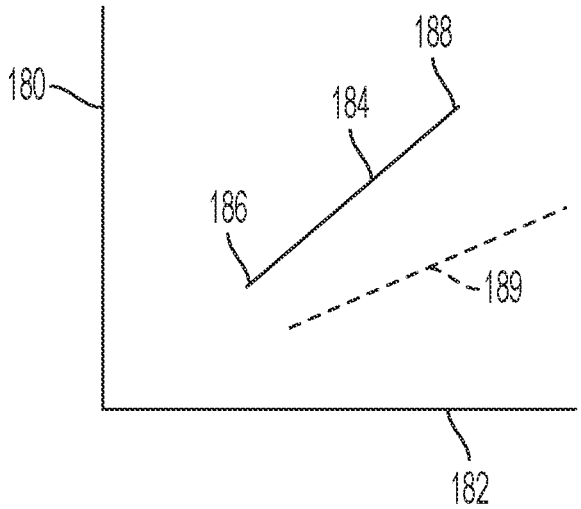
FIG. 3 is a graph representing regulated operation of the internal combustion engine in accordance with a rated engine speed range having a rated minimum engine speed and a rated maximum engine speed.
Figure 4:
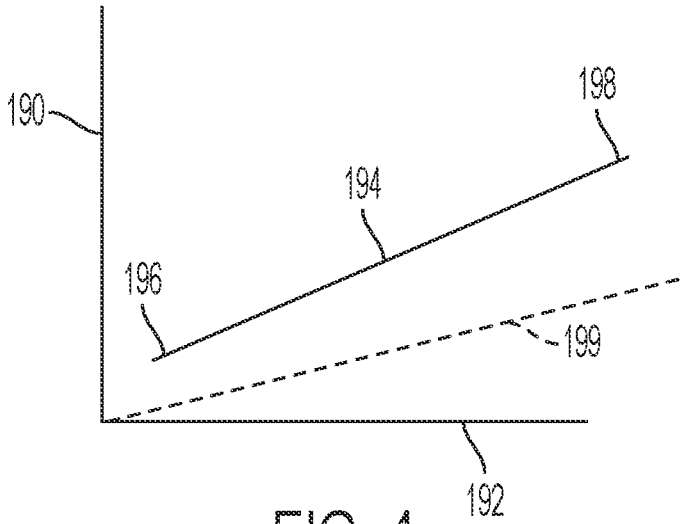
FIG. 4 is a graph representing regulated operation of the internal combustion engine in accordance with an adjusted engine speed range having an adjusted minimum engine speed and an adjusted maximum engine speed.

FIGS. 3 and 4 graphically illustrate the difference between operating the mobile machine 100 under a rated engine speed range associated with the internal combustion engine 114 and under an adjusted engine speed range that allows for different minimum and maximum speeds of the mobile machine 100. In FIG. 3, the Y-axis 180 represents the operator's input to the internal combustion engine 114, which may be indicated by depressing the speed pedal 142 and the resulting rotation speed output by the engine may be represented by the X-axis 182, which may be in RPM. The rated engine speed range may be represented by the plotted solid line 184 with an associated rated minimum engine speed 186 and rated maximum engine speed 188. The resulting velocity or travel speed of the mobile machine 100 that is correlated to the rated engine speed range can also be graphically represented by the dashed line 189, in which case the X-axis 182 may be in MPH.

In FIG. 4 represents an adjusted engine speed range that, in an embodiment, may have a wider range than the rated engine speed range. For example, the Y-axis 190 that represents the operator's commanded input to the internal combustion engine 114 may have the same range or values as in FIG. 3. However, the resulting rotational speed output of the engine represented by the X-axis 192 may be wider, as indicated by the adjust engine speed range represented by the plotted solid line 194 with a different adjusted minimum engine speed 196 and adjusted maximum engine speed 198. The resulting velocity or travel speed of the mobile machine 100 represented by the dashed line 199 and that is correlated to the adjusted engine speed range 194 may also be different, e.g., wider, than as depicted in FIG. 3. In an alternative embodiment, the adjusted engine speed range 194 may be narrower that the rated engine speed range 184 depicted in FIG. 3 with the adjusted minimum engine speed 196 being greater than the rated minimum engine speed 186 and the adjusted maximum engine speed 198 being less than the rated maximum engine speed 188.

While there may be conditions where it is desirable to operate the internal combustion engine 114 with an adjusted engine speed range 194 that is different from the rated engine speed range 184, such operation may also be detrimental if done for a prolonged time. For example, operating the internal combustion engine 114 at a minimum adjusted engine speed that is lower than the minimum rated engine speed increases the risk of the engine stalling. Operating the internal combustion 114 at an adjusted maximum engine speed that is greater than rated maximum engine speed risks overheating damaging the engine. Accordingly, the control strategy described herein operates the internal combustion engine 114 at the adjusted engine speed range only temporarily and only when beneficial to the operation of the mobile machine 100.

Figure 5:
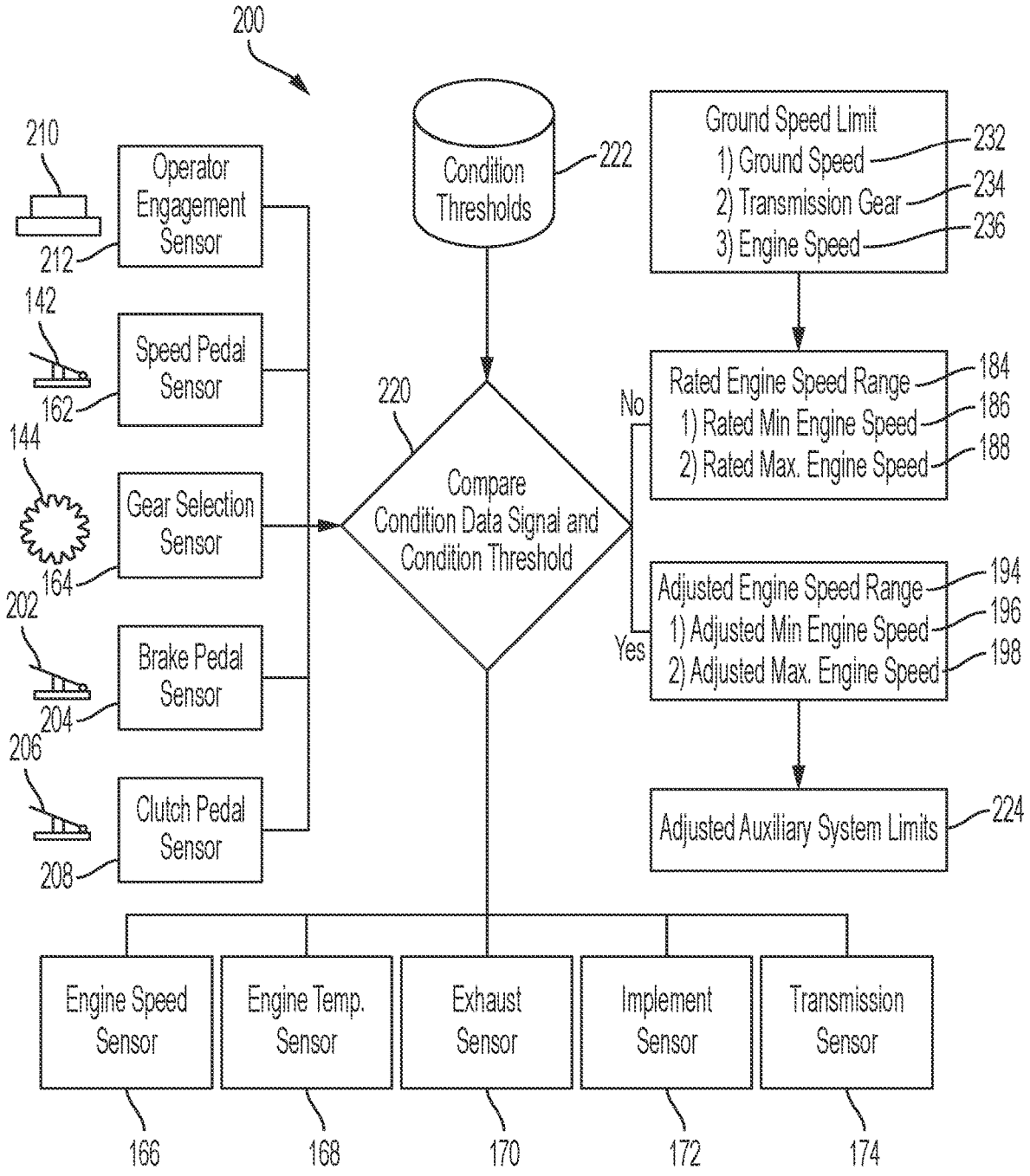
FIG. 5 is a schematic block diagram representing possible condition data signals that may be input to a speed control program to regulate the engine speed ranges of the internal combustion engine.

To determine whether to operate the internal combustion engine 114 under either the rated engine speed range or the adjusted engine speed range, the electronic controller 150 can receive, process, and analyze the condition data signals received from the plurality of input condition sensors 160. Referring to FIG. 5, with continued reference to the previous figures, there is schematically illustrated a possible process or routine 200 by which the electronic controller 150 can selectively switch between applying the rated engine speed range or the adjusted engine speed range to regulate operation of the internal combustion engine 114 and drivetrain 118 under particular operating conditions and states of the mobile machine.

For example, the electronic controller 150 may receive condition data signals from the speed pedal sensor 162 operatively associated with the speed pedal 142 that are indicative of the commanded velocity or ground speed of the mobile machine 100 requested by the operator. The electronic controller 150 can also receive condition data signals from the gear selection sensor 164 operatively associated with the gearshift stick 144 through which the operator may command or selected the fixed gear ratio for the transmission 120. In a further embodiment, as indicated above, the mobile machine 100 can be equipped with a brake pedal 202 through which the operator may attempt to retard or decelerate the velocity of the mobile machine with respect to the work surface 102. The electronic controller 150 may receive condition data signals from a brake pedal sensor 204 operatively associated with the brake pedal 202. Likewise, the mobile machine 100 can include a clutch pedal 206 to engage and disengage the transmission 120 from the internal combustion engine 114, and the electronic controller 150 can receive condition data signals from a clutch pedal sensor 208 associated with the clutch pedal 206 indicative of whether the clutch pedal is engaged or disengaged.

In addition to the foregoing input conditions, which may be considered associated with inputs or commands from the operator, the electronic controller 150 can also receive condition data signals indicative of the performance or operational state of the mobile machine 100 or the mechanical systems thereon. For example, the electronic controller 150 can receive condition signals regarding the internal combustion engine 114, such as the engine rotational speed and/or torque from the engine speed sensor 166. The electronic controller 150 can also receive condition data signals indicative of the operating temperature of the engine from the engine temperature sensor 168. Furthermore, the electronic controller 150 can also receive condition data signals from the exhaust sensor 170 that may be indicative of the temperature and/or chemical constituents of the exhaust gases in the exhaust system 116. As mentioned above, the ground-engaging implement 106 such as a blade can also be equipped with an implement sensor 172, such as a position sensor or a force load sensor, and the corresponding condition data signals may be communicated to the electronic controller 150. Further, the electronic controller 150 can also receive condition data signals from a transmission sensor 174 associated with the transmission 120.

In an embodiment, to initiate or enable the electronic controller 150 to selectively switch between the rated engine speed range 184 and the adjusted engine speed range 194, an operator engagement input/output device 210 and an associated operator engagement sensor 212 may be included. The operator engagement input/output device 210 allows an operator to control the availability of regulating the internal combustion engine 114 under the adjusted conditions so as to prevent unintended or undesired changes in operation of the mobile machine. The operator engagement input/output device 210 may, for example, be a button or switch accessible by the operator. In an embodiment, the operator engagement input/output device 210 may be associated with an operational state or mode in which mobile machine 100 is operating, for example, a finish mode when the operator is operating the mobile machine at relatively slow speeds to preform precision alterations of the work surface 102 with the ground-engaging implement 106. In such an embodiment, the adjusted engine speed range may only be available when the operator engagement input/output device 210 has been activated.

The electronic controller 150 can be configured with a comparison routine 220 or algorithm that can compare the condition data signals received from the condition input sensors 160 with condition thresholds 222 to determine whether to operate the internal combustion engine 114 under the rated engine speed range or the adjusted engine speed range. The condition thresholds 222 can be predetermined values stored as computer readable data in memory or a database associated with the electronic controller 150. The condition thresholds 222 may be determined empirically and can represent the operational conditions or states under which it can be desirable to adjust the rated engine speed range of the internal combustion engine 114 to conduct the present task or operation of the mobile machine 100. For example, the condition thresholds 222 may include data for the commanded or applied velocity or travel speed of the mobile machine 100, the performance of the internal combustion engine such as operating engine temperature, and the loading condition of the ground-engaging implement.

By way of example, the electronic controller 150 may by default operate or regulate operation of the internal combustion engine 114 within the rated engine speed range 184 with an associated rated minimum engine speed 186 and rated maximum engine speed 188 that limits the rotational speed output of the engine. The rated engine speed range 184 may be embodied as a computer readable table or map of values stored within memory associated the electronic controller 150. The rated engine speed range 184 may be based on or determined by the physical design and construction of the internal combustion engine 114.

If the comparison routine 220 conducted by the electronic controller 150 determines the condition data signal corresponds with the condition thresholds 222, the electronic controller can select to operate the internal combustion engine 114 in accordance with the adjusted engine speed range 194. The adjusted engine speed range 194 may have an adjusted minimum engine speed 196 and an adjusted maximum engine speed 198 that are different from the rated minimum engine speed 186 and the rated maximum engine speed 188. Accordingly, when the appropriate operational conditions occur, the electronic controller 150 regulates the internal combustion engine differently and with a different available velocities or travel speeds or than if the conditions had not occurred. In an embodiment, if the operating conditions sensed by the plurality of condition input sensors 160 revert, the electronic controller 150 may switch again from regulating the internal combustion engine under the adjusted engine speed range 194 to regulation under the rated engine speed range 184. Accordingly, the internal combustion engine may be operated beyond its rated engine speed range for a limited duration.

In an embodiment, when the electronic controller 150 is regulating the internal combustion engine 114 in accordance with the adjusted engine speed range 194, the electronic controller 150 may also make adjustments to the operation of one or more of the auxiliary systems associated with the mobile machine 100. For example, the adjusted engine speed range 194 enables the internal combustion engine 114 to operate at slower or faster rotational speeds than are rated engine speed range 184, the internal combustion engine has a larger chance of stalling or sustaining damage due to overheating. The electronic controller 150 can conduct a limitation routine 224 to apply adjusted operational limits on the auxiliary systems to limit or reduce the rotational power or torque diverted from the drivetrain 118 to those systems, and thereby reduce the load on the internal combustion engine 114 due to these auxiliary systems.

In a further possible embodiment, additional operational limits or adjustments may be applied to the engine speed in consideration of the ground speed of the mobile machine. For instance, the electronic controller 150 or another control system may be programmed with a ground speed control 230 in which the ground speed 232 of the mobile machine is determined, for example, directly by a sensor associated with the propulsion devices or indirectly by an algorithm.

The ground speed 232 may be indicative of the travel speed of the mobile machine 100 with respect to the work surface 102. The ground speed 232 may also be related to the maneuverability of the mobile machine 100, such as with respect to maneuvering about objects about the work surface 102, or maneuvering and guiding the mobile machine with regard to the terrain of the work surface, or with respect to the operation being performed by the machine.

The ground speed control 230 can process the ground speed 232 as measured to determine and apply adjustments or limits to the engine speed of the internal combustion engine. For example, by applying appropriate mathematical calculations to the ground speed 232 as measured and other variables, like the selected gear ratio 234 of the transmission 120, the ground speed control 230 can determine the engine speed 236 of the internal combustion engine. As stated, the ground speed control 232 can apply additional adjustments or limits on the engine speed 236 in consideration of the maneuvering of the mobile machine, for example, by further adjusting or limiting the adjusted maximum engine speed 198.

INDUSTRIAL APPLICABILITY

Figure 6:
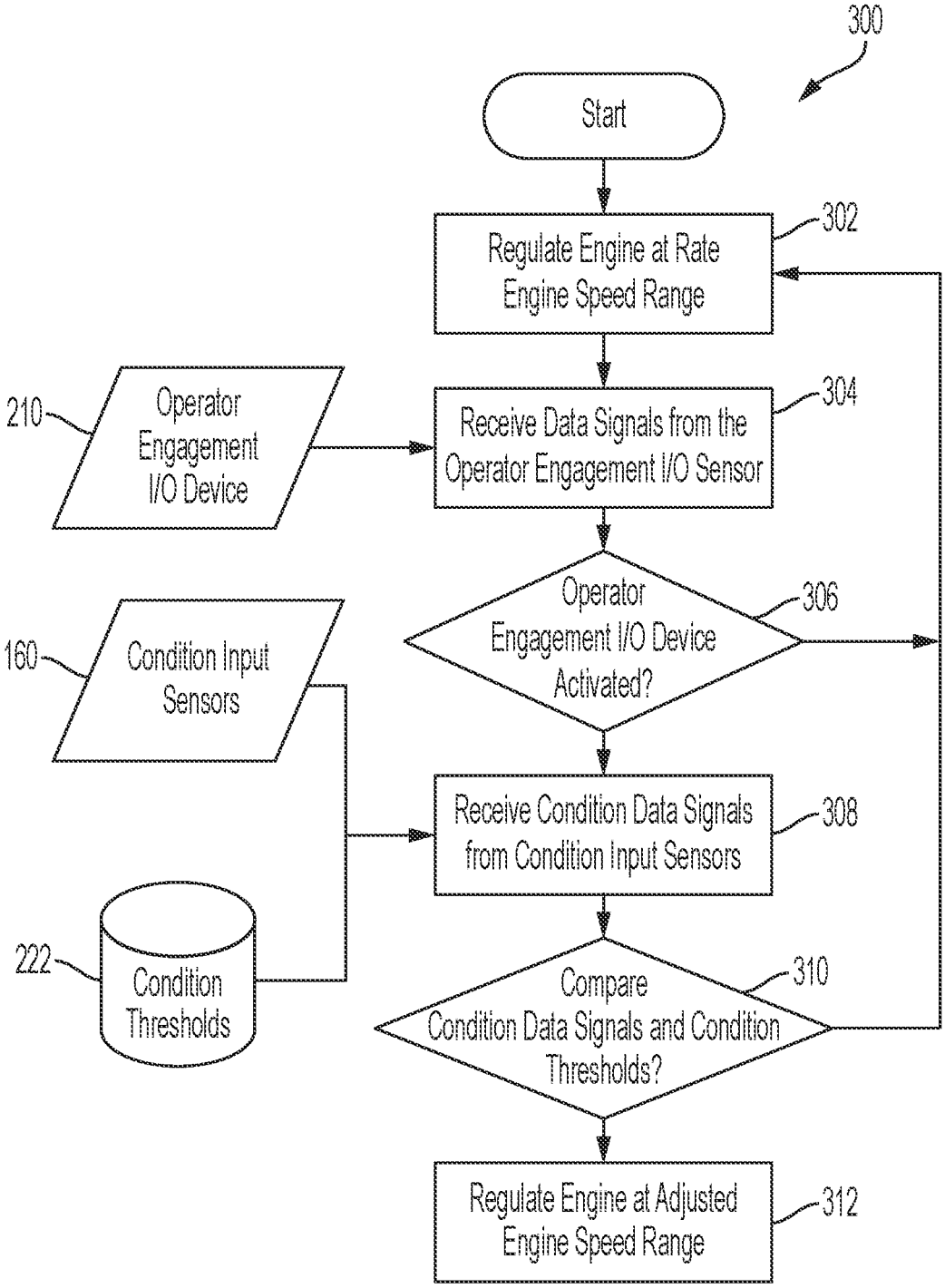
FIG. 6 is a flow diagram of a possible routine for regulating the engine speed ranges of the internal combustion engine based on the condition data signals that may be conducted by the speed control program.

Referring to FIG. 6, with continued reference to the preceding figures, there is illustrated an embodiment of a routine 300 for controlling the speed of a mobile machine in accordance with the disclosure. The routine 300 can be embodied as a computer software program written in a programming language and executable by the electronic controller 150. In an initial rated regulating step 302, the electronic controller 150 may regulate operation of the internal combustion engine 114 in accordance with a rated engine speed range 184 having a rated minimum engine speed 186 and a rated maximum engine speed 188. The rated engine speed range 184 can be based on the physical design constraints of internal combustion engine 114 and may be suggested by the manufacturer.

The operator may desire to operate the mobile machine 100 at different speeds than are available in the rated engine speed range 184, for example, during a finishing operation wherein the operator is attempting to more precisely alter the work surface 102 with the ground-engaging implement 106 such as a blade. In particular, the operator may desire to operate the mobile machine 100 at a slower velocity or speed to facilitate precision contouring of the work surface 102. Accordingly, in an operator engagement step 304, the electronic controller 150 via the routine 300 can receive an operator engagement data signal from an operator engagement input/output device 210 to enable and/or disable the ability of the electronic controller 150 to change between regulating the internal combustion engine 114 in accordance with the rated engine speed range 184 and with an adjusted engine speed range 194. In activation decision step 306, the electronic controller 150 assesses whether the operator engagement input/output device 210 has been activated, enabling the ability of the controller to change between the rated engine speed range 184 and the adjusted engine speed range 194. If the operator engagement input/output device 210 has not been activated, the electronic controller continues to regulate operation of the internal combustion engine 114 within the rated engine speed range 184.

If the activation decision step 306 concludes that the operator has activated the operator engagement input/output device 210, the electronic controller 150 via the routine 300 can receive one or more condition data signals from the plurality of input condition sensors 160 in a condition data signal reception step 308. The conditional data signals may be indicative of the operational settings, operational states of the mechanical components, and/or the performance of the mobile machine. To assess the condition data signals, the electronic controller 150 can also receive one or more condition thresholds 222 during the condition data signal reception step 308. The condition thresholds 222 may be predetermined values to evaluate the operating conditions of the mobile machine 100 and may be further indicative of the desirability of operating the mobile machine at different speeds than are available in the rated engine speed range 184.

The electronic controller 150 via the routine 300 can conduct a condition data signal assessment step 310 in which the electronic controller compares the condition data signals and the condition thresholds 222. If the condition data signal assessment step 310 determines the condition data signals do not meet or exceed the condition thresholds 222, the electronic controller 150 can continue regulating operation of the internal combustion engine 114 in accordance with the rated engine speed range 184. If the condition data signal assessment step 310 determines the condition data signals meet or exceed the condition thresholds 222, the electronic controller 150 can switch to regulating operation of the internal combustion engine 114 in accordance with the adjusted engine speed range 194 by initiating an adjusted regulating step 312. The adjusted engine speed range 194 may have an adjusted minimum engine speed 196 and an adjusted maximum engine speed 198 that are different from the rated minimum engine speed 186 and the rated maximum engine speed 188 associated with the rated engine speed range 184.

In an embodiment, the adjusted engine speed range 194 may expand the rated engine speed range 184. For example, the adjusted minimum engine speed 196 may be less than the rated minimum engine speed 186 to enable the operator to operate the mobile machine 100 at a reduced velocity or speed than typical, for example, during a finishing operation or mode. Further, the adjusted maximum engine speed 198 may be greater than the rated maximum engine speed 188 thereby expanding the available rotational speeds of the internal combustion engine 114. In another embodiment, the adjusted engine speed range 194 may be narrower than the rated engine speed range 184. For example, the adjusted minimum engine speed 196 may be greater than the rated minimum engine speed 186 and the adjusted maximum engine speed 198 may be lesser than the rated maximum engine speed 188 thereby narrowing the available rotational speeds of the internal combustion engine 114.

It should be appreciated from the foregoing that the disclosure provides an advantageous way of adjusting the available rotation speeds of an internal combustion engine and thus the velocity or travel speed of a mobile machine during specific operations such as a finishing operation wherein a ground-engaging implement is used to precisely contour a work surface. These and other advantages and features of the disclosure should be apparent from the foregoing specification and accompanying drawings.

It will be appreciated that the foregoing description provides examples of the disclosed system and technique. However, it is contemplated that other implementations of the disclosure may differ in detail from the foregoing examples. All references to the disclosure or examples thereof are intended to reference the particular example being discussed at that point and are not intended to imply any limitation as to the scope of the disclosure more generally. All language of distinction and disparagement with respect to certain features is intended to indicate a lack of preference for those features, but not to exclude such from the scope of the disclosure entirely unless otherwise indicated.

Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context.

The use of the terms "a" and "an" and "the" and "at least one" and similar referents in the context of describing the invention (especially in the context of the following claims) are to be construed to cover both the singular and the plural, unless otherwise indicated herein or clearly contradicted by context. The use of the term "at least one" followed by a list of one or more items (for example, "at least one of A and B") is to be construed to mean one item selected from the listed items (A or B) or any combination of two or more of the listed items (A and B), unless otherwise indicated herein or clearly contradicted by context.

Accordingly, this disclosure includes all modifications and equivalents of the subject matter recited in the claims appended hereto as permitted by applicable law. Moreover, any combination of the above-described elements in all possible variations thereof is encompassed by the disclosure unless otherwise indicated herein or otherwise clearly contradicted by context.

We claim:

1. A mobile machine for an earth working operation, the mobile machine comprising:

a machine frame supported on a plurality of propulsion devices for travel over a work surface;

an internal combustion engine supported on the machine frame and operatively connected to the plurality of propulsion devices by a drivetrain, the internal combustion engine operating at a rotational speed;

a transmission disposed in the drivetrain, the transmission having a plurality of fixed gear ratios;

a plurality of condition input sensors configured to sense one or more operating conditions of the mobile machine; and an electronic controller in data communication with the plurality of condition input sensors to receive condition data signals, the electronic controller programmed to:

regulate operation of the internal combustion engine in accordance with a rated engine speed range that constrains the rotational speed of the internal combustion engine to a rated minimum engine speed and a rated maximum engine speed, compare the condition data signals with one or more condition thresholds, and regulate operation of the internal combustion engine, based on the comparison, in accordance with an adjusted engine speed range that constrains the rotational speed of the internal combustion engine to an adjusted minimum engine speed and an adjusted maximum engine speed that are respectively different from the rated minimum engine speed and the rated maximum engine speed.

2. The mobile machine of claim 1, further comprising an operator engagement input/output device that enables and disenables ability of the electronic controller to change between the rated engine speed range and the adjusted engine speed range.

3. The mobile machine of claim 1, wherein the plurality of fixed gear ratios includes a low gear ratio and the electronic controller compares the condition data signals with the one or more condition thresholds only when the transmission is in the low gear ratio.

4. The mobile machine of claim 1, wherein the plurality of condition input sensors include a speed pedal sensor operatively associated with a speed pedal of the mobile machine.

5. The mobile machine of claim 1, wherein the plurality of condition input sensors include an implement sensor operatively associated with a ground-engaging implement of the mobile machine supported on the machine frame.

6. The mobile machine of claim 5, wherein the implement sensor senses a load force applied to the ground-engaging implement.

7. The mobile machine of claim 1, wherein at least some of the plurality of condition input sensors are selected from the group consisting of an engine speed sensor, an engine temperature sensor, and an exhaust sensor.

8. The mobile machine of claim 1, wherein the adjusted engine speed range expands the rated engine speed range.

9. The mobile machine of claim 1, wherein the adjusted engine speed range narrows the rated engine speed range.

10. The mobile machine of claim 1, further comprising one or more auxiliary power takeoffs operatively disposed in the drivetrain and operatively connected with one or more auxiliary systems of the mobile machine.

11. The mobile machine of claim 10, wherein the electronic controller is programmed to limit operation of the one or more auxiliary systems when the electronic controller is regulating operation of the internal combustion engine in accordance with the adjusted engine speed range.

12. A method of speed control for a mobile machine comprising:

regulating operation of an internal combustion engine within a rated engine speed range associated with a rated minimum engine speed and a rated maximum engine speed of the internal combustion engine;

transmitting rotational speed from the internal combustion engine through a drivetrain to a plurality of propulsion devices for travel, of the mobile machine, over a work surface;

receiving a condition data signal from a condition input sensor indicative of a change in an operating condition of the mobile machine;

comparing the condition data signal with a condition threshold; and regulating operation of the internal combustion engine, based on the comparison, within an adjusted engine speed range including an adjusted minimum engine speed and an adjusted maximum engine speed that are different from the rated minimum engine speed and rated maximum engine speed, respectively.

13. The method of claim 12, further comprising receiving an operator engagement data signal from an operator engagement input/output device to enable and disenable changing between the rated engine speed range and the adjusted engine speed range.

14. The method of claim 12, further comprising detecting, with a gear selection sensor, a selected gear ratio of a transmission disposed in the drivetrain and having a plurality of fixed gear ratios, wherein the step of regulating operation of the internal combustion engine within the adjusted engine speed range occurs only when a low gear ratio of the plurality of fixed gear ratios is the selected gear ratio.

15. The method of claim 12, wherein the adjusted engine speed range expands the rated engine speed range.

16. The method of claim 12, wherein adjusted engine speed range narrows the rated engine speed range.

17. The method of claim 12, further comprising:

operatively connecting one or more auxiliary systems to the drivetrain with an auxiliary power takeoff, and limiting operation of the one or more auxiliary systems when regulating operation of the internal combustion engine within the adjusted engine speed range.

18. A speed control system for a mobile machine comprising:

a plurality of condition input sensors configured to sense one or more operating conditions of the mobile machine and to communicate condition data signals indicative of the one or more operating conditions; and an electronic controller programmed to:

regulate operation of an internal combustion engine in accordance with a rated engine speed range having a rated minimum engine speed and a rated maximum engine speed, compare the condition data signals with one or more condition thresholds, and regulate operation of the internal combustion engine, based on the comparison, in accordance with an adjusted engine speed range having an adjusted minimum engine speed and an adjusted maximum engine speed that are respectively different from the rated minimum engine speed and the rated maximum engine speed.

19. The speed control system of claim 18, further comprising an operator engagement input/output device in data communication with the electronic controller, wherein the electronic controller is able to change between the rated engine speed range and the adjusted engine speed range upon activation of the operator engagement input/output device.

20. The speed control system of claim 18, wherein the electronic controller is further configured to limit operation of one or more auxiliary power systems associated with the mobile machine when regulating operation of the internal combustion engine in accordance with the adjusted engine speed range.

* * * * *